US008914951B2

(12) United States Patent
Gaudillere et al.

(10) Patent No.: US 8,914,951 B2
(45) Date of Patent: Dec. 23, 2014

(54) MAGNETIC FASTENING BUCKLE PROVIDED WITH PERMANENT MAGNETS AND A MECHANICAL LOCKING

(75) Inventors: Antonin Gaudillere, Grenoble (FR); Alain Maurice, Saint Hilaire du Touvet (FR)

(73) Assignee: Zedel, Crolles (FR)

( * ) Notice: Subject to any disclaimer, the term of this patent is extended or adjusted under 35 U.S.C. 154(b) by 240 days.

(21) Appl. No.: 13/441,256

(22) Filed: Apr. 6, 2012

(65) Prior Publication Data

US 2012/0255144 A1 Oct. 11, 2012

(30) Foreign Application Priority Data

Apr. 6, 2011 (FR) ..... 11 01039

(51) Int. Cl.
*A44B 11/25* (2006.01)
*H01F 7/02* (2006.01)
*A44B 11/26* (2006.01)

(52) U.S. Cl.
CPC ..... *A44B 11/266* (2013.01)
USPC ..... 24/303

(58) Field of Classification Search
USPC ..... 24/303
See application file for complete search history.

(56) References Cited

U.S. PATENT DOCUMENTS

| | | | | |
|---|---|---|---|---|
| 2,615,227 | A * | 10/1952 | Hornik | 24/303 |
| 3,589,341 | A * | 6/1971 | Krebs | 119/865 |
| 4,991,272 | A | 2/1991 | Bianchi | |
| 5,311,647 | A * | 5/1994 | Levy | 24/303 |
| 6,640,398 | B2 * | 11/2003 | Hoffman | 24/303 |
| 6,857,169 | B2 * | 2/2005 | Chung | 24/303 |
| 6,981,391 | B2 * | 1/2006 | Suzuki | 63/3.1 |
| 7,152,282 | B2 * | 12/2006 | Costa | 24/303 |
| 7,308,737 | B2 * | 12/2007 | Saitoh et al. | 24/303 |
| 7,523,527 | B2 * | 4/2009 | Garber | 24/303 |
| 8,427,294 | B2 * | 4/2013 | Cheung | 340/457.1 |
| 2006/0174455 | A1 * | 8/2006 | Saitoh et al. | 24/303 |
| 2009/0106950 | A1 * | 4/2009 | Cope | 24/303 |
| 2010/0325844 | A1 | 12/2010 | Fiedler | |
| 2011/0131770 | A1 | 6/2011 | Fiedler | |

FOREIGN PATENT DOCUMENTS

| | | | |
|---|---|---|---|
| EP | 1 243 192 | A2 | 9/2002 |
| WO | WO 2008/006355 | A2 | 1/2008 |
| WO | WO 2009/010049 | A2 | 1/2009 |
| WO | WO 2009/103279 | A2 | 8/2009 |

* cited by examiner

*Primary Examiner* — Robert J Sandy
*Assistant Examiner* — David Upchurch
(74) *Attorney, Agent, or Firm* — Oliff PLC

(57) ABSTRACT

A magnetic fastening buckle includes a first plug-in element provided with a first permanent magnet, and a second receiving element that includes a flat support plate surmounted by a support cap for a second permanent magnet. A pair of guiding pins protrudes on both sides of a first opening in which is inserted the first permanent magnet. The guiding pins are parallel to the longitudinal axis of the buckle, so as to ensure a self-entering effect of the first plug-in element in said longitudinal direction.

4 Claims, 9 Drawing Sheets

MAGNETIC FASTENING BUCKLE PROVIDED WITH PERMANENT MAGNETS AND A MECHANICAL LOCKING

TECHNICAL FIELD OF THE INVENTION

The invention relates to a magnetic fastening buckle including:

- a first plug-in element provided with a first permanent magnet and at least one locking arm intended to take a locked position when closing the buckle, and a unlocked position for opening the buckle,
- a second receiving element including an open space into which the first plug-in element is inserted by magnetic attraction, said second receiving element comprising a second permanent magnet so that the juxtaposed poles of the two magnets opposite one another have opposite magnetic polarities.

STATE OF THE ART

The document WO 2008/006355 describes a fastening buckle provided with a permanent magnet, and a pair of locking levers on one of the coupling elements. The other coupling element is provided with a fixed ferromagnetic yoke transversely placed in a groove extending perpendicular to the coupling direction of both elements. The magnetic flux of the permanent magnet is channeled by the yoke, which causes a magnetic attraction between the elements, followed by a mechanical locking when, the buckle is closed. Nevertheless, the magnetic attraction effect remains insufficient because of the moderated magnetic field generated by the magnet. It is then necessary to guide the mobile element at a certain distance, to the detriment of the buckle overall dimensions.

The document WO 2009/103279 mentions a magnetic fastener buckle provided with two permanent magnets with opposite polarities. Nevertheless, centering the plug-in element requires means difficult to implement.

OBJECT OF THE INVENTION

The object of the invention aims at providing a magnetic fastening buckle with a fast interlocking and small overall dimensions.

The fastening buckle according to the invention is characterized in that the body of the first plug-in element comprises a pair of guiding pins protruding on both sides of a first housing opening in the first permanent magnet, both guiding pins being parallel to the longitudinal axis of the buckle, and the second receiving element being provided with a flat support plate, the whole being able to ensure a self-centering effect for the first plug-in element in said longitudinal direction.

In addition, this magnetic self-centering effect results from the distribution of the magnetic field lines of the two magnets, which are in opposite directions on both sides of the longitudinal axis. The uniform magnetic attraction in the air-gap between the two permanent magnets tends to axially move the first plug-in element until it comes into contact with the second receiving element. The buckle is maintained by magnetic attraction in the closed position in a secure way through the mechanical blocking of the locking arms in the cap.

According to a preferential embodiment, the two permanent magnets are formed by cylindrical studs with axial polarization, and extending in alignment with the longitudinal axis. The cap of the second receiving element is provided with a pair of recesses arranged on both sides of a second housing opening in the second permanent magnet, the recesses being intended to receive in the attraction closing position said guiding pins, as well as stops provided at the ends of the locking arms.

The permanent magnets can be made out of a ferrous material (iron, steel, nickel, cobalt, etc.) or out of ferrite.

BRIEF DESCRIPTION OF THE DRAWINGS

Other advantages and characteristics will more clearly arise from the following description of an embodiment of the invention given as a nonrestrictive example and represented in the annexed drawings, in which.

DETAILED DESCRIPTION OF THE INVENTION

Figure 1:
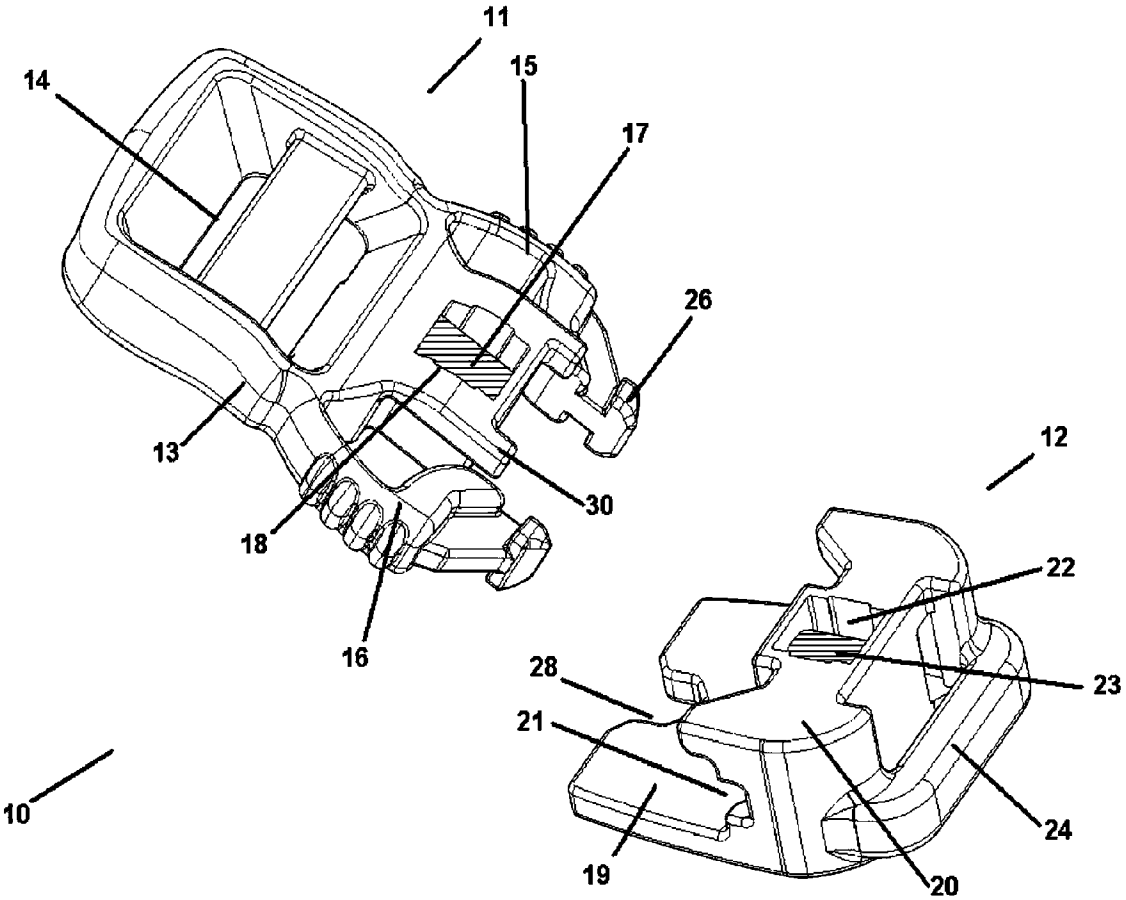
FIG. 1 is a perspective view of the fastening buckle according to the invention, represented in the disconnected state.
Figure 2:
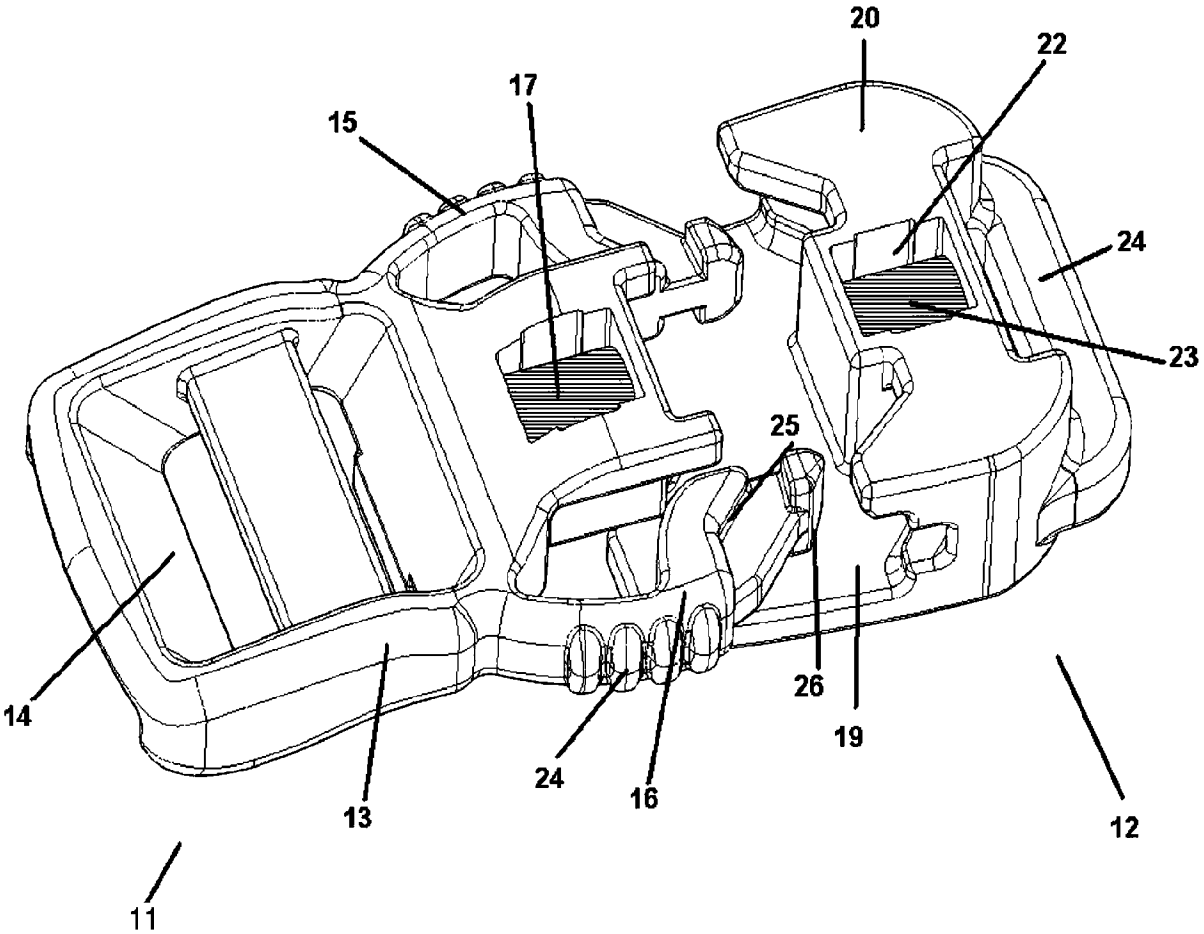
FIG. 2 shows a view identical to that in FIG. 1, during the coupling phase of the buckle.

In the figures, a magnetic fastening buckle 10 comprises a first plug-in element 11 intended to be inserted into a second receiving element 12 to ensure the closing of the fastening buckle 10.

The first plug-in element 11 includes a body 13 out of molded plastic material, having at one of the ends a first slotted device 14 provided with slots for the passage of a strap, a pair of locking arms 15, 16 extending in a coplanar way along the opposite sides, and a first permanent magnet 17 placed in a first central opening 18 in the body 13 between the two locking arms 15, 16. One of the ends of each locking arm 15, 16 is overhangly integral with the body 13 in order to allow an elastic side deformation during the manual phase of unlocking.

The second receiving element 12 is provided with a flat support plate 19 surmounted by a cap 20 delimiting an open space 21 for receiving the locking arms 15, 16, and a second opening 22 in which a second permanent magnet 23 is placed. A second slotted device 24 is provided at the back of the cap 20 for the passage of the other strap end.

The two permanent magnets 17, 23 are formed for example by cylindrical studs out of magnetized magnetic material, said studs being aligned according to the longitudinal axis XY. The permanent magnets 17, 23 can be made out of a ferrous material (iron, steel, nickel, cobalt, etc.) or out of ferrite. Each permanent magnet 17, 23 includes a pole N and a pole S, respectively located at each end of the studs. The poles of the two permanent magnets 17, 23 opposite each other have opposite magnetic polarities so as to create a magnetic attraction effect between them.

Figure 5:
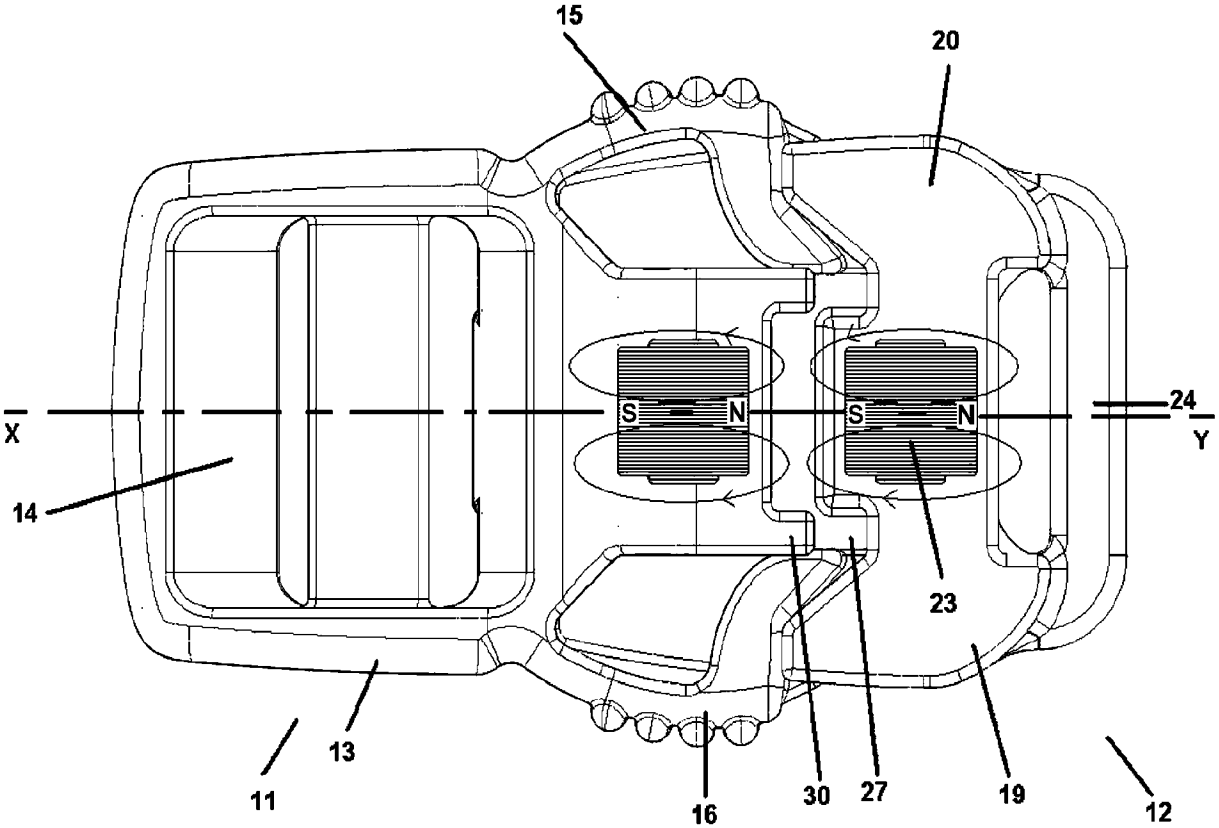

As it is shown for example in FIG. 5, the pole N of the first permanent magnet 17 is positioned axially facing the pole S of the second permanent magnet 23. When the two elements 11 and 12 move towards each other in the horizontal plane parallel to the support plate 19, the magnetic field lines of the pole N of the first permanent magnet 17 are in the opposite direction relative to those entering the pole S of the second permanent magnet 23. From that, it results that the two magnets 17, 23 are magnetically attracted by each other and the two elements 11, 12 comes into contact with each other, which corresponds to the closing position of the buckle (illustrated in FIG. 6).

Both locking arms 15, 16 have identical profiles symmetrical relative to the vertical median plane whose trace is the longitudinal axis XY. Each elastic locking arm 15, 16 is composed of a gripping sector 24, and of a guiding surface 25 ending at the free end by a stop 26.

In addition, the body 13 comprises two guiding pins 30 protruding on both sides of the first opening 18 of the magnet 17 so as to contribute to the longitudinal centering of the first plug-in element 11.

The cap 20 of the second receiving element 12 is provided with a pair of recesses 27 arranged on both sides of the second opening 22 in the magnet 23. At the end of the closing course of the buckle, the stop 26 of each locking arm 15, 16, and the guiding pins 30 enter the corresponding recesses 27 of the cap 20 to ensure both the centering and the mechanical locking in the closing position.

The input of the support plate 19 is advantageously provided with a positioning notch 28 into which a guiding protuberance 29 for the body 13 is axially inserted during the magnetic attraction course.

Figure 3:
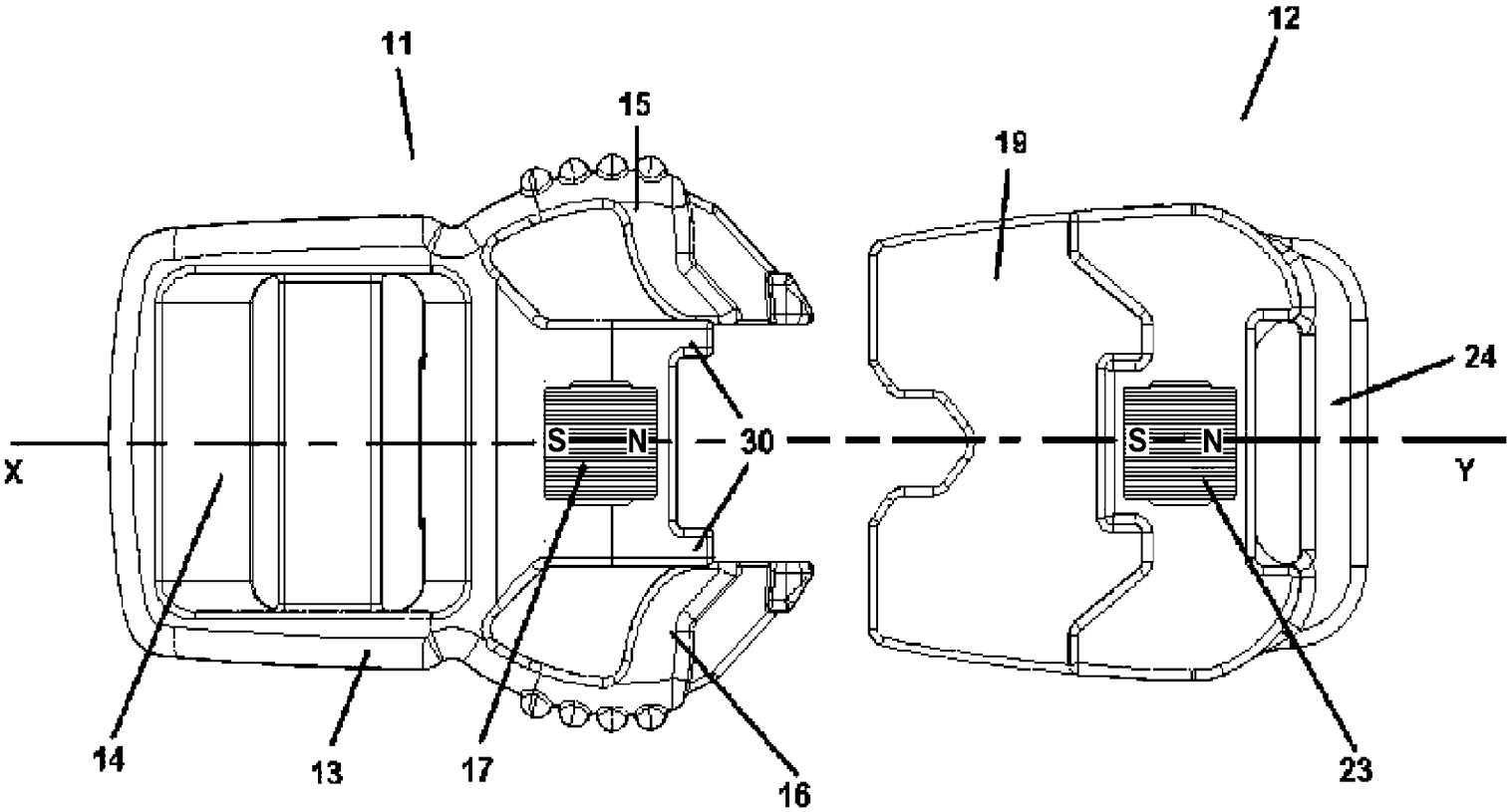
FIGS. 3 to 6 represent a top view of the buckle, respectively in the opening position at the beginning of the phase of insertion, then during the progressive displacement by magnetic attraction along the support plate, and at the end of the closing course after the mechanical locking.
Figure 4:
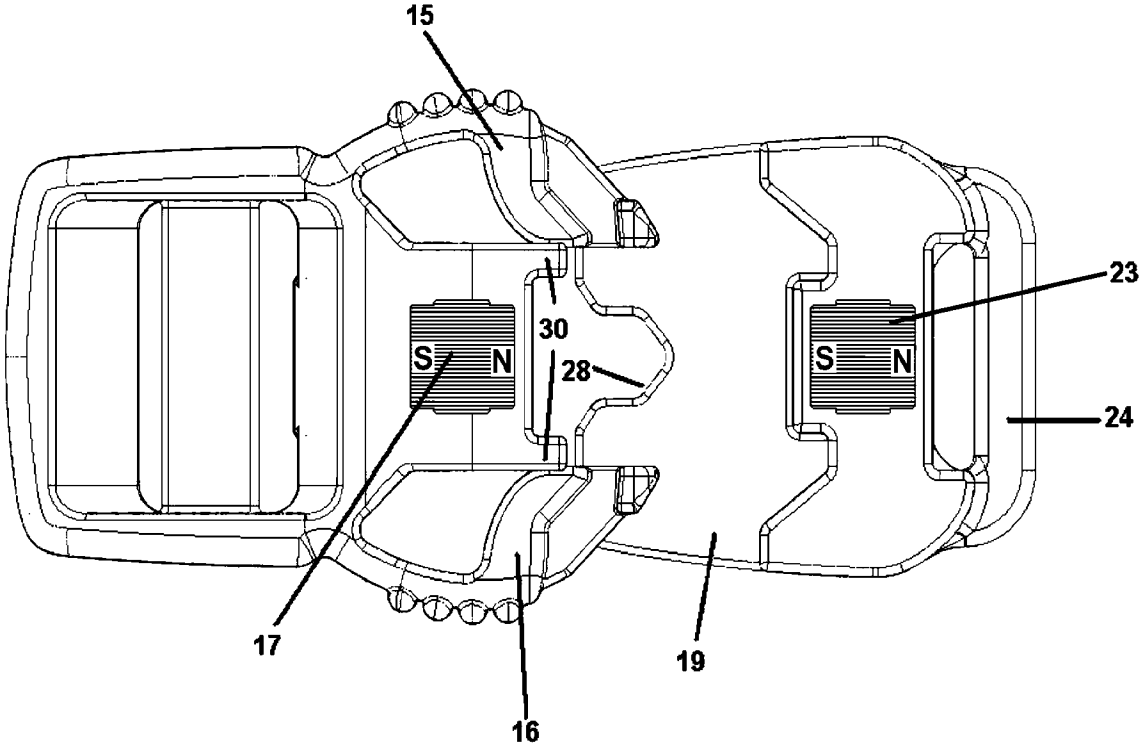

The closing and the opening of the magnetic fastening buckle 10 are carried out in the following way:

From the opening position represented in FIG. 3, it is enough to bring the first plug-in element 11 and the second receiving element 12 closer together so that the magnetic attraction is established between the two permanent magnets 17, 23. Both locking arms 15, 16 move over the support plate 19 towards the cap 20, the magnetic attraction increasing as the air-gap between the two magnets 17, 23 decreases.

Figure 6:
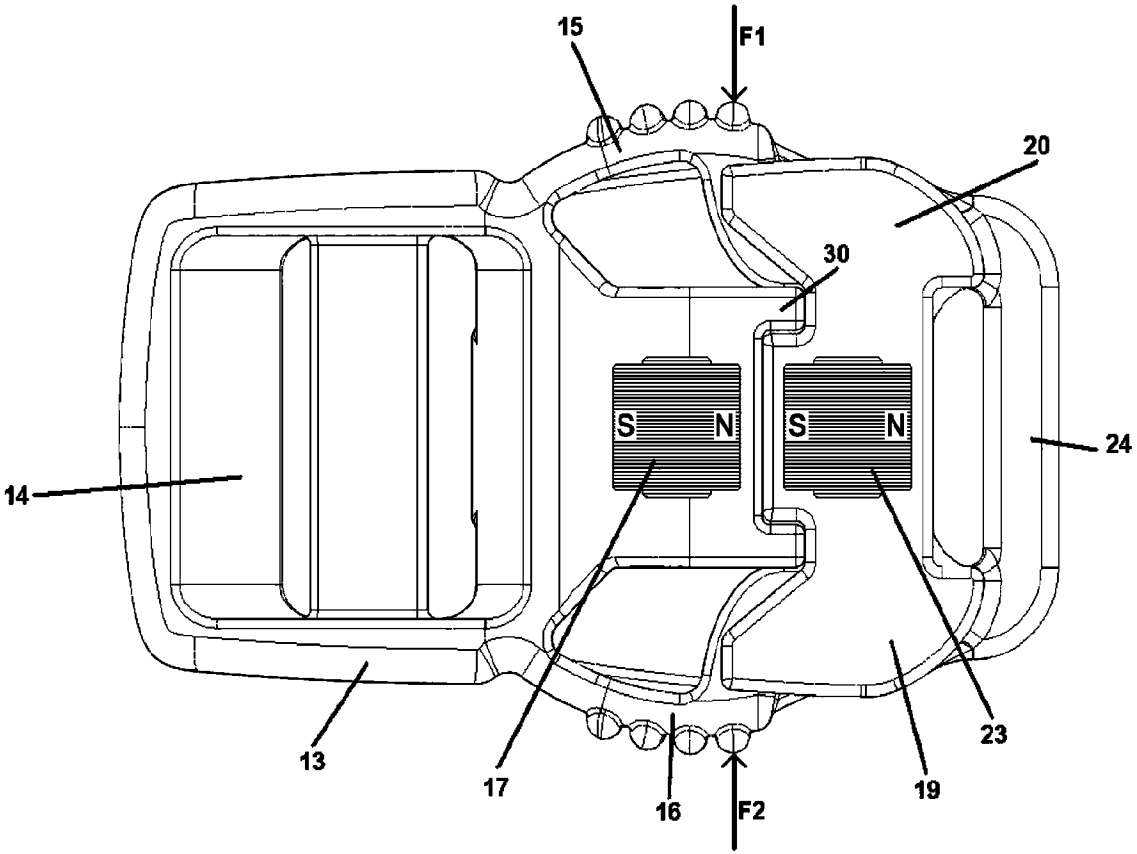
Figure 7:
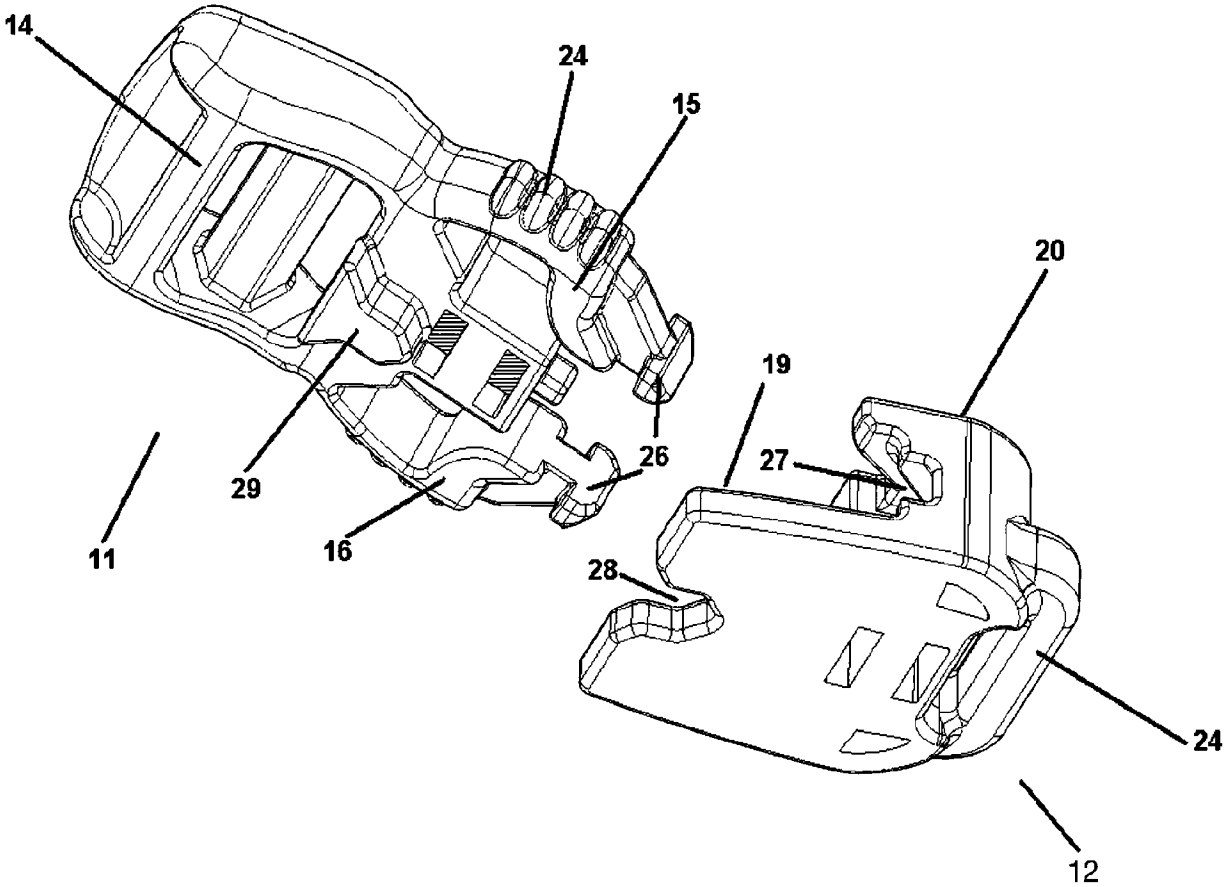
FIGS. 7 and 8 are perspective bottom views of the buckle, respectively in the disconnected position, and during the insertion.
Figure 8:
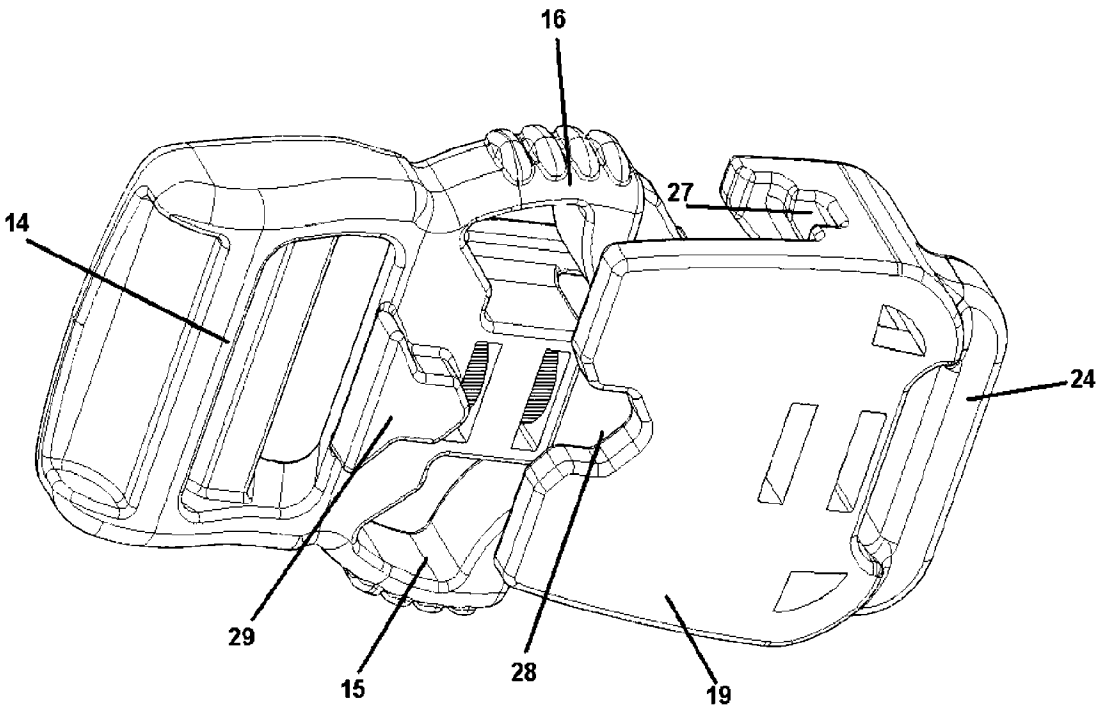
Figure 9:
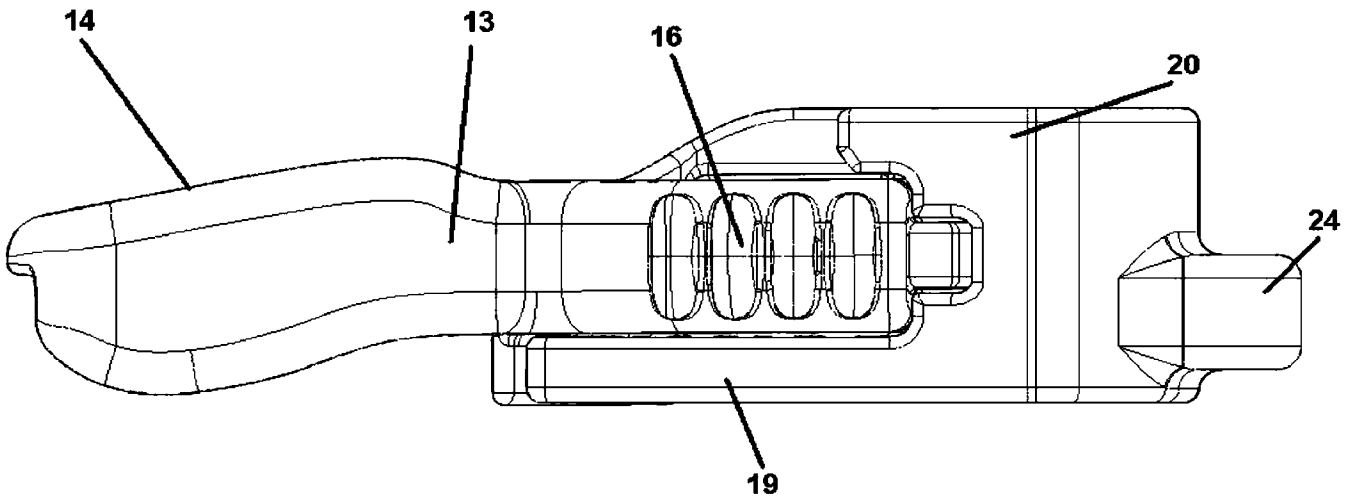
FIG. 9 shows a side view of the buckle in the closing position.

In the centered position in FIG. 5, it can be noted that the magnetic field lines of the two magnets 17, 23 are in opposite directions on both sides of the longitudinal axis XY. The magnetic attraction is thus uniform in all the air-gap, and allows an axial displacement of the first plug-in element 11 until it comes into contact with the second receiving element 12 (FIG. 6). In this closed position of the buckle, the guiding pins 30 and the stops 30 are inserted into the recesses 27, and the protuberance is placed in the notch 28. Moreover, the buckle is magnetically maintained in the closed position in a secure way through the mechanical blocking of the locking arms 15, 16 in the cap 20.

It is essential that the first plug-in element 11 should be brought closer along and over the support plate 19 of the second receiving element 12. In the event of a slope or of a random positioning of the first plug-in element 11, the system composed of the two magnets 17, 23 generates in the air-gap repulsive magnetic fields likely to restore an axial guidance in the longitudinal direction XY.

To open the buckle, it is enough to laterally hold the locking arms 15, 16 between two fingers in the opposite directions of the arrows F1 and F2 in order to ensure the mechanical unlocking. The first plug-in element 11 is then submitted to a manual axial traction and moved away at the same time from the second receiving element 12, the force of traction being opposite, and higher than, the force of magnetic attraction of the magnets 17, 23.

The invention claimed is:

1. A magnetic fastening buckle comprising:

a first plug-in element having a body provided with a first permanent magnet located in a first opening of said body, and a pair of locking arms configured to lock in response to a closing of the buckle, and to unlock in response to an opening of the buckle, the pair of locking arms being elastic and extending along opposite sides of the body, each locking arm having a gripping sector configured to unlock the buckle, and a stop configured to mechanically lock the buckle in a longitudinal direction;

a second receiving element including an open space into which the first plug-in element is inserted by magnetic attraction, said second receiving element including a second permanent magnet so that the first permanent magnet and the second permanent magnet have opposite magnetic polarities facing each other;

a pair of guiding pins protruding on both sides of the first opening, and being parallel to the longitudinal axis of the buckle; and flat support plate located at the base of the second receiving element, and cooperating with the guiding pins to provide a self-centering effect of the first plug-in element alone the longitudinal direction upon magnetic attraction of the magnets.

2. The magnetic fastening buckle according to claim 1, wherein the first and second permanent magnets are formed by cylindrical studs with axial polarization, and configured to extend in alignment with the longitudinal direction.

3. The magnetic fastening buckle according to claim 1, wherein the second receiving element includes a cap provided with a pair of recesses arranged on both sides of a second opening into which the second permanent magnet is inserted, said recesses being arranged to receive in the attraction closing position said guiding pins, as well as said stops of the locking arms.

4. The magnetic fastening buckle according to claim 1, wherein the support plate of the second receiving element includes a positioning notch into which a guiding protuberance of the first plug-in element is axially inserted when the permanent magnets are brought together.

* * * * *